US006794954B2

(12) United States Patent
Gurvich et al.

(10) Patent No.: US 6,794,954 B2
(45) Date of Patent: Sep. 21, 2004

(54) MICROSTRIP COUPLER

(75) Inventors: Mark Gurvich, Costa Mesa, CA (US); Alex Rabinovich, Cypress, CA (US); Jianquing He, Cerritos, CA (US)

(73) Assignee: Power Wave Technologies, Inc., Santa Ana, CA (US)

( * ) Notice: Subject to any disclaimer, the term of this patent is extended or adjusted under 35 U.S.C. 154(b) by 197 days.

(21) Appl. No.: 10/045,837

(22) Filed: Jan. 11, 2002

(65) Prior Publication Data

US 2003/0132816 A1 Jul. 17, 2003

(51) Int. Cl.[7] ..... H01P 5/18
(52) U.S. Cl. ..... 333/116; 333/112
(58) Field of Search ..... 333/116, 109, 333/110, 111, 112, 115, 128, 24 R

(56) References Cited

U.S. PATENT DOCUMENTS

| | | | | |
|---|---|---|---|---|
| 2,860,308 A | * | 11/1958 | Bales | 333/116 |
| 3,516,024 A | | 6/1970 | Lange | 333/10 |
| 4,178,568 A | | 12/1979 | Gunton | 333/116 |
| 4,216,446 A | * | 8/1980 | Iwer | 333/112 |
| 4,288,761 A | | 9/1981 | Hopfer | 333/116 |
| 4,636,754 A | | 1/1987 | Presser et al. | 333/116 |
| 4,723,307 A | | 2/1988 | Clark et al. | 455/103 |
| 4,937,541 A | | 6/1990 | Podell et al. | 333/116 |
| 5,105,171 A | | 4/1992 | Wen et al. | 333/116 |
| 5,159,298 A | | 10/1992 | Dydyk | 333/112 |
| 5,281,929 A | | 1/1994 | Willems | 333/116 |
| 5,376,904 A | | 12/1994 | Wong | 333/1 |
| 5,424,694 A | | 6/1995 | Maloratsky et al. | 333/112 |
| 5,521,563 A | | 5/1996 | Mazzochette | 333/116 |
| 5,629,654 A | | 5/1997 | Frick | 333/116 |
| 5,689,217 A | * | 11/1997 | Gu et al. | 333/116 |
| 5,767,753 A | * | 6/1998 | Ruelke | 333/116 |
| 6,147,570 A | | 11/2000 | Gill | 333/116 |
| 6,150,898 A | | 11/2000 | Kushitani et al. | 333/110 |

OTHER PUBLICATIONS

Bryant, et al., "Parameters of Microstrip Transmission Lines and of Coupled Pairs of Microstrip Lines", *IEEE Transactions on Microwave Theory and Techniques*, vol. MTT–16, No. 12, Dec. 1968.

Herzog, H.J., "Microstrip Couplers with Improved Directivity", *Electronics Letters*, vol. 14, No. 3, Feb. 2, 1978.

Schaller, G., "Directivity Improvement of Microstrip N4–Directional Couplers", *AEU*, vol. 26, No. 11, 1972, pp. 508–509.

Rehnmark, S., "High Directivity CTL–Couplers and a New Technique for the Measurement of CTL–Coupler Parameters", *IEEE Transactions on Microwave Theory and Techniques*, vol. MTT–25, No. 12, Dec. 1977, pp. 1116–1121.

(List continued on next page.)

*Primary Examiner*—Robert Pascal
*Assistant Examiner*—Dean Takaoka
(74) *Attorney, Agent, or Firm*—Paul B. Heynssens; Hogan & Hartson LLP

(57) ABSTRACT

A microstrip coupler is provided which includes an controlled capacitance bridge for improved directivity as compared to prior art controlled capacitance bridges. The novel controlled capacitance bridge provides the functionality of prior art wire or ribbon controlled capacitance bridges and also provides the necessary capacitance to compensate for the different phase velocities of odd and even modes in the transmission lines. Both the dimensions of the controlled capacitance bridge and the dimensions of an input microstrip conductor may be adjusted to provide the appropriate level of capacitance. In some embodiments, the controlled capacitance bridge connects segments of an input microstrip conductor. In other embodiments, the controlled capacitance bridge connects microstrip conductors which are configured to couple an input signal from an input microstrip conductor.

12 Claims, 2 Drawing Sheets

OTHER PUBLICATIONS

Podell, A., "A High Directivity Microstrip Coupler Technique", *International Microwave Symposium Digest*, 1970 G–MTT, pp. 33–37.

Sheleg, B. et al., "Broad–Band Directional Couplers Using Microstrip with Dielectric Overlays", *IEEE Transactions on Microwave Therory and Techniques*, vol. MTT–22, No. 12, Dec. 1974, pp. 1216–1220.

Alexopoulos, N. et al.,"Characteristics of Single and Coupled Microstrips on Anisotropic Substrates", *IEEE Transactions on Microwave Theory and Techniques*, vol. MTT–26, No. 6, Jun. 1978, pp. 387–393.

Aikawa, M., "Microstrip Line Directional Coupler with Tight Coupling and High Directivity", *The Transactions of the IECE of Japan*, vol. E 60, No. 4, Abstracts, pp. 206–207, Apr. 1977.

Lange, J., "Interdigitated Stripline Quandrature Hybrid", *IEEE Transactions on Microwave Theory and Techniques*, Dec. 1969, pp. 1150–1151.

Presser, A., "Interdigitated Microstrip Coupler Design", *IEEE Transactions on Microwave Theory and Techniques*, vol. MTT–26, No. 10, Oct. 1978, pp. 801–805.

Kumar, et al., "Monolithic GaAs Interdigitated 90 Degree Hybrids With 50– and 25– OHM Impedances", 1982 IEEE Microwaves & Millimeter Wave Circuits Symposium, Dallas, TX 1982.

Lange, J., "Interdigitated Stripline Quadrature Hybird", *G–MTT Int., Microwave Symposium Digest*, pp. 10–13, May 1969.

Lane, J., "Interdigitated Stripline Quadrature Hybrid", *IEEE Transactions on Microwave Theory and Techniques*, Dec. 1969, pp. 1150–1151.

Waugh, R. et al., "Unfolding the Lange Coupler", *IEEE Transactions on Microwave Theory and Techniques*,, Nov. 1972, MTT–20, pp. 777–779.

* cited by examiner

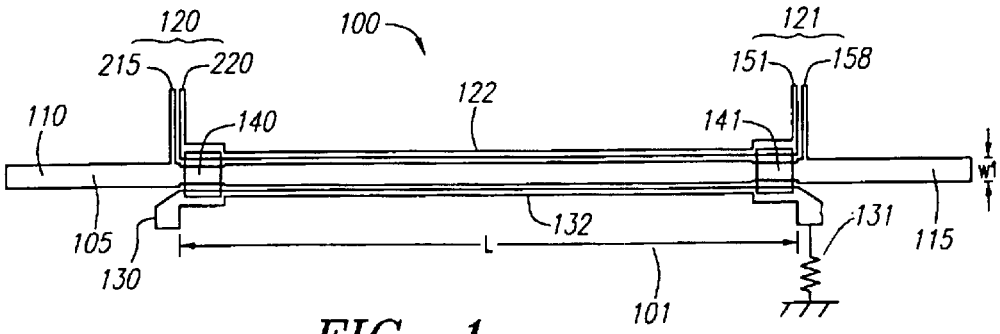
FIG. 1
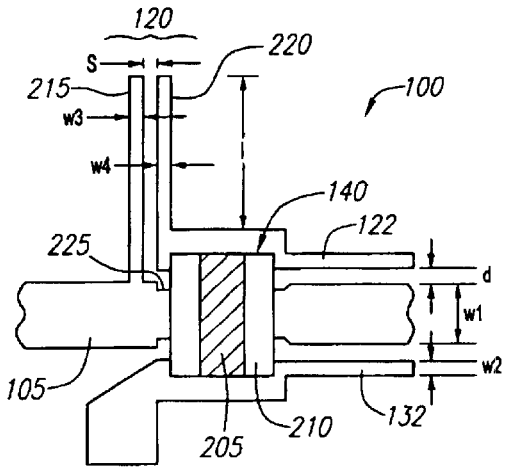
FIG. 2
FIG. 3
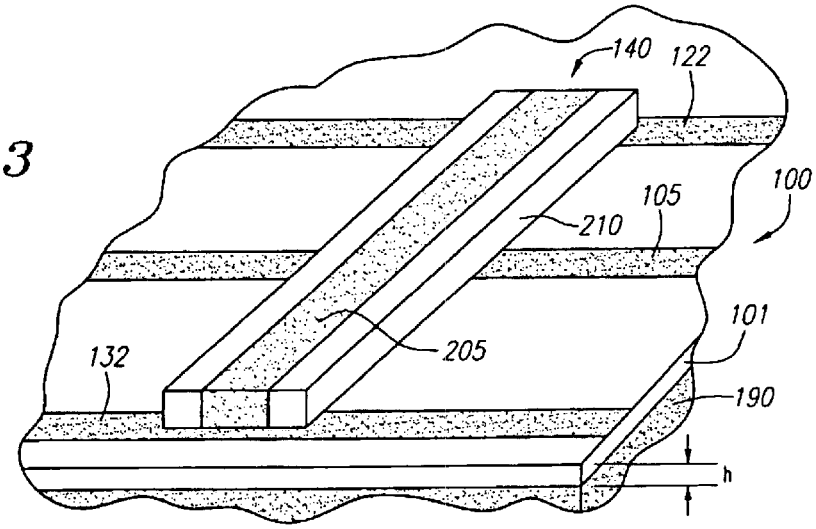

MICROSTRIP COUPLER

This application relates generally to the field of coupling devices for electrical circuits and in particular to the field of directional couplers.

BACKGROUND OF THE INVENTION

Directional couplers which include parallel microstrip conductors mounted on a dielectric, commonly referred to as microstrip couplers, are widely used in various types of circuits, including high frequency RF (radio frequency) and microwave circuits. Microstrip couplers are often used in connection with signal sampling (power monitoring), signal splitting and combining, signal injection and other applications.

If a directional coupler is not properly terminated, reflected waves travel back from the load to the input. These reflected waves cause degradation in the performance of the system. In a type of conventional microstrip coupler called a Lange coupler, wire or ribbon conductors are typically used to form "controlled capacitance bridges." Controlled capacitance bridges are often used to connect alternating split microstrip conductors and these bridges typically reduce parasitic inductance. However, there is typically a parasitic capacitance associated with an controlled capacitance bridge that is not easily controlled. Such parasitic capacitance affects the circuit performance adversely. Since this capacitance affects coupler performance, it is desirable to control the amount of capacitance present and account for the amount of capacitance present while designing the coupler. The Lange coupler is described in U.S. Pat. No. 3,516,024 ("the Lange patent"), which is hereby incorporated by reference.

The characteristic impedance of a microstrip coupler is a function of the product of the impedances of the even and odd modes of TEM transmission. The degree of coupling is a function of the ratio of the even and odd mode impedances. Odd and even mode phase velocities in the microstrip conductors are not equal and this difference in velocity leads to poor directivity. The directivity generally becomes worse as the coupling is decreased. As will be appreciated by those skilled in the art, a compensating capacitor is typically placed between one or more coupled microstrip conductors and an input microstrip conductor to improve directivity.

Accordingly, port impedance, coupling, and directivity are important characteristics that need to be considered in the design of a directional coupler in order to achieve proper termination. However, in a conventional broadside-coupled directional coupler, the coupling and matching port impedance cannot be independently adjusted. As a result, circuit designers must often abandon the directional coupler approach and use alternative circuit designs, or use an additional matching circuit to complete a circuit design. Thus, it would be desirable to provide a coupler that utilizes a controlled parasitic capacitance bridge in providing a coupler having improved directivity.

SUMMARY OF THE INVENTION

According to one aspect of the presently-claimed invention, a microstrip coupler includes: a first microstrip conductor configured to carry an input signal; a second microstrip conductor disposed along a first side of the first microstrip conductor and configured to couple at least a portion of the input signal; a third microstrip conductor disposed along a second side of the first microstrip conductor and configured to couple at least a portion of the input signal; and a first controlled capacitance bridge connecting the second microstrip conductor and the third microstrip conductor. The controlled capacitance bridge includes a conducting layer and a dielectric layer situated between the conducting layer and the first microstrip conductor.

According to another aspect of the present invention, an controlled capacitance bridge is provided for connecting a first microstrip conductor and a second microstrip conductor of a microstrip coupler. The first microstrip conductor is disposed along a first side of a third microstrip conductor configured to carry an input signal and the second microstrip conductor is disposed along a second side of the third microstrip conductor. The controlled capacitance bridge includes a conducting layer and a dielectric layer situated between the conducting layer and the third microstrip coupler.

According to another aspect of the present invention, a microstrip coupler includes: an input microstrip conductor configured to carry an input signal; a central microstrip conductor proximate the input microstrip conductor and separated from the input microstrip conductor by a first gap; an output microstrip conductor proximate the central microstrip conductor and separated from the central microstrip conductor by a second gap; a coupling microstrip conductor for coupling at least a portion of the input signal A first controlled capacitance bridge connects the input microstrip conductor and the central microstrip conductor. The first controlled capacitance bridge includes a first conducting layer and a first dielectric situated between the first conducting layer and the first gap. A second controlled capacitance bridge connects the central microstrip conductor and the output microstrip conductor. The second controlled capacitance bridge includes a second conducting layer and a second dielectric situated between the second conducting layer and the second gap.

DESCRIPTION OF THE DRAWINGS

FIG. 1 is top view of an embodiment of a microstrip coupler according to the present invention.

FIG. 2 is an enlarged view of one portion of the embodiment shown in FIG. 1.

FIG. 3 is a perspective diagram of the controlled capacitance bridge according to an embodiment of the present invention.

DETAILED DESCRIPTION OF THE DRAWINGS

Figure 4:
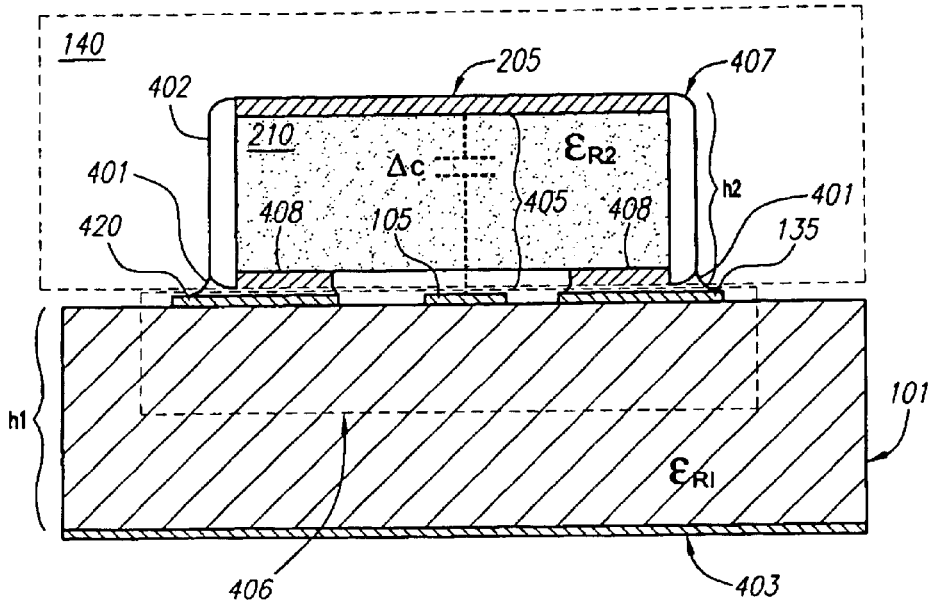
FIG. 4 is a cross-section of the controlled capacitance bridge depicted in FIG. 3.

FIG. 1 illustrates the principal features of one embodiment of microstrip coupler 100 according to the present invention. The exemplary coupler shown is a 12 dB coupler. Those skilled in the art will appreciate that a 12 dB coupler is exemplary and that circuits other than those presented to produce a coupling on a given material are within the scope of the invention.

The microstrip coupler 100 is disposed upon a substrate 101. One exemplary substrate 101 is made of Teflon-Glass commercially available dielectric material, having a relative dielectric constant $\in_r$ of 3.5, and a thickness h1 of 0.020 in. However, in other embodiments of the present invention, substrate 101 is formed of ceramic, Teflon, glass, epoxy and other substances having a variety of dielectric constants and thicknesses.

Exemplary microstrip conductor ("main line") 105, having a width w1 of 0.044 in., forms a through line including an input portion ("input port") 110 and an output portion ("output port") 115. When microstrip coupler 100 is in operation, signals enter input port 110 and are transmitted along microstrip conductor 105 to output port 115.

A first segment 122 of a first coupled microstrip conductor ("first coupled line") and a second segment 132 of a second coupled microstrip conductor ("second coupled line") extend parallel to each other along opposite sides of the microstrip conductor through line 105. The first coupled line 122 and the second coupled line 132 collect a portion of the signal energy transmitted through microstrip conductor 105. Typically, first microstrip conductor 122 and second microstrip conductor 132 are designed to have an electrical length "L" of $\lambda/4$, where $\lambda$ is a wavelength of a design frequency of a signal present at a mid-band of operation microstrip coupler 100. In one exemplary embodiment $\lambda/4$ corresponds to a length L of 0.884 in.

In alternative embodiments, the electrical length L of first and second microstrip conductors 122 and 132 vary from a quarter wavelength. Variations in length L are typically utilized to change the shape of a characteristic curve of coupling over frequency, by methods known to those skilled in the art.

In further alternative embodiments, multiple $\lambda/4$ length sections of different widths may be used to achieve a controlled amount of coupling over frequency, as is known to those skilled in the art. For example, multiple $\lambda/4$ length sections of microstrip line of varying impedances (or equivalently, short-stepped impedance transformers, whose design is known to those skilled in the art) may be cascaded in order to achieve a controlled degree of coupling over frequency, for example, a Tschebychaev characteristic.

In the embodiment shown in FIG. 1, a pair of similarly constructed controlled capacitance bridges 140, 141 span the microstrip conductor 105 without making direct electrical contact with the conductor 105. In many embodiments of the present invention, there is capacitive coupling between a conductor disposed on the outer surface of controlled capacitance bridges 140, 141 and microstrip conductor 105. Controlled capacitance bridges 140, 141 couple the pair of microstrip lines 122, 132, that are disposed parallel to each other and on opposite sides of the main microstrip conductor 105. Thus, microstrip conductors 132 and 122 are of substantially equal length L and disposed parallel to each other and on opposite sides of a main microstrip conductor 105. The conductors 122, 132 are typically spaced a fixed distance "d" from main microstrip conductor 110. The distance "d" is chosen to achieve a desired coupling by methods known to those skilled in the art.

The ends of microstrip conductors 122 and 132 are coupled together by controlled impedance bridges 140 and 141 that cross over the main microstrip conductor 105 without directly contacting it. In other words, the first and second coupled lines 122, 132 are running in parallel on either side of through line 105. First and second coupled lines 122, 132 are directly tied together at their extreme ends by a pair of controlled impedance bridges 140, 141.

In the embodiment shown in FIG. 1, controlled impedance bridges 140, 141 are disposed at opposite ends of coupled segments 122 and 132. In one exemplary embodiment, zero Ohm surface mount jumpers are used to provide a controlled impedance bridge. However, those skilled in the art will realize that other materials may be used to provide a fixed impedance bridge. In some alternative embodiments of microstrip coupler 100, a single controlled impedance bridge, constructed similarly to controlled capacitance bridge 140 or 141, may be utilized to connect coupled segments 122 and 132. In some embodiments of microstrip coupler 100, controlled capacitance bridge 140 or 141 connect coupled segments 122 and 132 at points other than the ends. In further alternative embodiments of microstrip coupler 100, one or more pairs of additional coupled microstrip conductors are cascaded with microstrip conductors 122, 132 at their ends. In such embodiments, controlled capacitance bridges connect the additional microstrip conductors across microstrip conductor 105, as described above.

Adjacent to the controlled capacitance bridges, pairs of trim traces are disposed to provide a trimable, or adjustable, capacitance. In the embodiment shown, a first pair of trim traces 120 and a second pair of trim traces 121 are disposed at the input 105 and the output 115 of the coupler, respectively. Trim traces 120, 121, consisting of parallel copper traces 215, 220, 151 and 158 of microstrip conductors 105 and 122, provide an additional capacitance. This additional capacitance is typically used to adjust the performance of microstrip coupler 100 in addition to the capacitance provided by controlled capacitance bridges 140, 141. In particular, the capacitances provided by the pairs of trim traces 120, 121 typically affect coupler directivity. The trim traces 120, 121 are shown as parallel conductors disposed on the substrate 101 and separated by a gap(s). In the exemplary embodiment gap 's' is 0.010 in. Each pair of trim traces 120, 121 provides capacitance inversely proportional to the spacing between conductors and proportional to their length as is known to those skilled in the art. In one exemplary embodiment, the capacitively coupled length 'l' is 0.151 in.

The first pair of trim traces 120 includes first trim trace conductor 215 coupled to main transmission line 105 at the input 110 of main transmission line 105. Second trim trace conductor 220 is coupled to first microstrip conductor 122. The second pair of trim traces 121 includes first trim trace conductor 158 coupled to microstrip conductor 105 at the output 115 of microstrip coupler 100. Second trim trace conductor 151 of the second pair of trim traces 150 is coupled to first microstrip conductor 122. Thus, a second trim trace line is coupled to each of the opposite ends of the first microstrip conductor 122, capacitively coupling each end to microstrip conductor 122.

Trim traces 120 and 121 provide a capacitance that is distributed along the length of two parallel conductors. However, those skilled in the art will realize that other forms of capacitance, such as a lumped capacitance, may be substituted for the distributed capacitance provided by pairs of trim traces. In some such embodiments, variable lumped capacitance is used in place of, or in combination with, the pairs of trim traces. Adjustment of the pairs of trim traces 120, 121 may be provided by shortening or lengthening the trim traces, utilizing methods known to those skilled in the art.

Second microstrip conductor 132 includes enlarged pad area 130 disposed near coupler input 110. From enlarged pad area 130 forward, coupled power originating from the input port 110 is typically channeled out of microstrip coupler 100. In the embodiment shown, the width of the enlarged pad area width has been selected such that a 50 ohm characteristic impedance is provided to an external load. Alternatively, other characteristic impedances may be provided by methods known to those skilled in the art.

At an opposite end or termination point of second microstrip conductor 132, a termination is typically provided.

Again, the trace width of one exemplary embodiment is adjusted to provide a 50 Ohm transmission line characteristic impedance. Alternatively, the trace widths at each end may be selected to provide other characteristic impedances to interface to any adjacent circuitry having differing characteristic impedance. At the termination port, a 50 Ohm termination, or load 131, is typically provided as adjacent circuitry. Alternatively, any circuit having a 50 Ohm characteristic impedance may be coupled to the second microstrip conductor, at the load port in place of the termination.

The pair of trim traces 120, 121 is coupled to the controlled capacitance bridges 140, 141. In the embodiment shown, the controlled capacitance bridges 140, 141 are disposed in close proximity to the pairs of trim traces 120, 121, respectively.

In the embodiment shown in FIG. 1, controlled capacitance bridges 140 and 141 are constructed such that their capacitance may be controlled through the manufacturing process. In this embodiment, controlled capacitance bridges 140 and 141 are constructed utilizing surface mount, 1210 case, zero Ohm jumpers, typically used in producing surface mount circuits. These zero Ohm jumpers will be described below with reference to FIGS. 2 through 5. The zero Ohm jumpers advantageously provide a controlled capacitance due to fixed spacing between the conductor portion on a top surface of the jumper and any circuitry present beneath the jumper.

Capacitance from the zero Ohm jumper conductor to the main transmission line 105 that forms the controlled capacitance bridges 140 and 141 is coupled in parallel to the capacitance provided by the pairs of trim traces 120, 121, such that the total capacitance is increased. Since the capacitance provided by the controlled capacitance bridge tends to be a repeatable quantity, the trim traces may be efficiently adjusted to achieve a desired coupler compensation. The capacitance of the controlled capacitance bridge may be adjusted by changing the width of the controlled capacitance bridge to increase or decrease the amount of conductor suspended over main line 105. Similarly, the spacing between the suspended conductors and main line 105 may be adjusted. Alternatively, a portion of main line 105 extending under the controlled capacitance bridge may be varied in width to realize a change in capacitance. These features will be described in more detail below with reference to FIGS. 2 and 5.

Split coupling structures such as those shown in FIG. 1 are advantageously used when relatively weaker coupling (for example, of less than 18 to 20 db) is desired. In a split coupling structure, more reliable coupling is typically provided than in single broadside-coupled transmission line structure. It is desirable to control and utilize the capacitance inherent in joining the split lines 122, 132 as an aid to adjusting input and output characteristics of microstrip coupler 100.

FIG. 2 depicts an enlarged portion of microstrip coupler 100 in the vicinity of input portion 110 of microstrip conductor 105. The output 115 is similarly constructed and not shown. Conducting portion 205 and dielectric portion 210 of controlled capacitance bridge 140 are more readily distinguishable in FIG. 2 than in FIG. 1.

In one exemplary embodiment, first and second coupled lines 122 and 132 each have a width "w2" of 0.010 in. Each of coupled lines 122 and 132 is spaced a distance "d" from through line 105. In one exemplary embodiment, d is 0.168 in. Those skilled in the art will realize that a spacing of 0.168 in. is exemplary and that other dimensions are possible.

In many embodiments of the present invention, controlled capacitance bridge 140 consists of a slab of dielectric 210 having a conductor 205 disposed on its top surface. In order for conductor 205 to connect microstrip conductors 122 and 132, conductor 205 is typically provided with an area of edge plating such that a direct connection is made from conductor 132 to the edge plating disposed on dielectric 210, which is coupled to conductor 205. In a similar manner, edge plating forms a direct connection from conductor 122 to the opposite end of conductor 205. Dielectric slab 210 has fixed dimensions. Accordingly, by using edge plating at the ends and a conductor 205 coupling these ends, the dimensions of the bridge connection are carefully controlled. Dielectric material 210 is typically ceramic, fiberglass, Teflon, or the like. The edge platings are disposed on dielectric 210 by conventional methods known to those skilled in the art.

Dielectrics 210 provide controlled distances between conductors 205 of controlled capacitance bridges 140, 141 of the present invention. The resulting separation of charge from the controlled capacitance bridge forms an additional compensating capacitance in parallel with the capacitance between the first trim trace microstrip conductor 150 and the second trim trace microstrip conductor 220. The controlled and repeatable capacitance in the present embodiments tends to improve the directivity of microstrip coupler 100 by compensating for the difference in phase velocity between even and odd modes of waves propagating along the line. The teachings regarding a method of determining an appropriate compensating capacitance such as disclosed in U.S. Pat. No. 5,159,298 may be used and are hereby incorporated by reference. However, those of skill in the art will appreciate that many other methods may be used to determine an appropriate compensating capacitance.

The compensating capacitance may be adjusted in various ways, such as by changing the thickness of dielectric 210 or by using different types of dielectric material. Capacitance may also be controlled by adjusting the width of microstrip conductor 105 in the region 225 spanned by controlled capacitance bridge 140. In the embodiment shown in FIG. 2, the capacitance contributed by controlled capacitance bridge 140 has been adjusted by narrowing the microstrip conductor in area 225 relative to microstrip conductor 105. In the embodiment shown, microstrip conductor 105 has been narrowed to 0.020 in. in area 225. However, in alternate embodiments of microstrip coupler 100, area 225 is as wide as, or wider than, the adjacent portions of microstrip conductor 105.

Additional capacitance is provided by the interaction between segment 215 of microstrip conductor 105 and segment 220 of microstrip conductor 122. The interaction of the microstrip conductor in the second pair of trim traces 121 is generally the same as that of the first pair of trim traces 120 and will not be described separately. In one exemplary embodiment of microstrip coupler 100, the length "l" over which the first pair of trim traces 120 are capacitively coupled is 0.151 inches long, segment 215 has a width "w3" of 0.010 inches and segment 220 has a width "w4" of 0.010 inches. Other embodiments of microstrip coupler 100 have varying lengths l and widths w1, w2, w3 and w4. In alternative embodiments of microstrip coupler 100, where additional capacitance is not desired, segments 215 and 220 are omitted.

FIG. 3 illustrates a perspective view of controlled capacitance bridge 140. In FIG. 3, controlled capacitance bridge 140 is bridging microstrip line 105 to connect microstrip lines 122 and 132. As previously discussed, controlled capacitance bridge 140 bridges over microstrip conductor 105 without making a direct electrical connection. Dielectric portion 210 of controlled capacitance bridge 140 separates conducting portion 205 from microstrip conductor 105 by a fixed distance, thereby forming a parasitic capacitance between conducting portion 205 and microstrip conductor 105. In many embodiments of the present invention, this parasitic capacitance is distributed along the length of two parallel conductors.

FIG. 3 illustrates dielectric 101, having thickness "h," upon which microstrip coupler 100 is mounted. Dielectric 101 is mounted on ground plane 190. As will be appreciated by those of skill in the art, thickness h will depend in part upon the dielectric constant of the material from which dielectric 101 is formed.

FIG. 4 is a cross-section of an embodiment of microstrip coupler shown in cross-section 406, including controlled capacitance bridge 140, also shown in cross-section. In this cross-section, microstrip conductor 105 extends in a direction perpendicular to the page. Microstrip conductors 420 and 135 are to the left and to the right, respectively, of microstrip conductor 105. Dielectric portion 210 is disposed between conducting portion 205 and microstrip conductor 150, thereby creating distributed capacitance $\Delta c$ in zone 405 between conducting portion 205 and microstrip conductor 150. The parasitic capacitance $\Delta c$ is a distributed capacitance in the region 405 having a relative dielectric constant $\in_{r2}$ which depends on the dialectic used. In some exemplary embodiments, relative dielectric constant $\in_{r2}$ is in the range of 9.5 to 10.0.

This capacitance is easily controlled because of the stable dimensions of controlled capacitance bridge 140. Therefore, the amount of parasitic capacitance is known with more certainty than that of a conventional controlled capacitance bridge. In the embodiment shown, controlled capacitance bridge 140 typically includes surface conductor 205 that is coupled to edge plating 402 and edge plating 407. To make the arrangement amenable to surface mounting, edge plating 402 and edge plating 407 are coupled to small conductive areas 408. The small conductive areas 408 are disposed on the side of the dielectric 210 opposite to conductor 205. In assembling an air bridge to a coupler, conductive areas 408 are typically coupled to conductor traces 420 and 135 of coupler assembly 406 via solder connections 401. Solder connection 401 is typically made by disposing a solder paste (not shown) on the desired areas of the coupler assembly 406, placing the controlled capacitance bridge 140 on the coupler assembly 406 and then heating the assembly (typically with IR radiation) to melt the solder paste.

In the exemplary embodiment shown, the conductive portions of coupler 406 are disposed on the top surface of the dielectric material 101, dielectric 101 has a relative dielectric constant $\in_{r1}$ of 3.5 and the substrate height, h, is 0.020 inches. One of skill in the art will realize that many variations of $\in_{r1}$ and h are within the scope of the present invention. On the dielectric surface opposite to that of the coupler, ground plane 403 is disposed.

Figure 5:
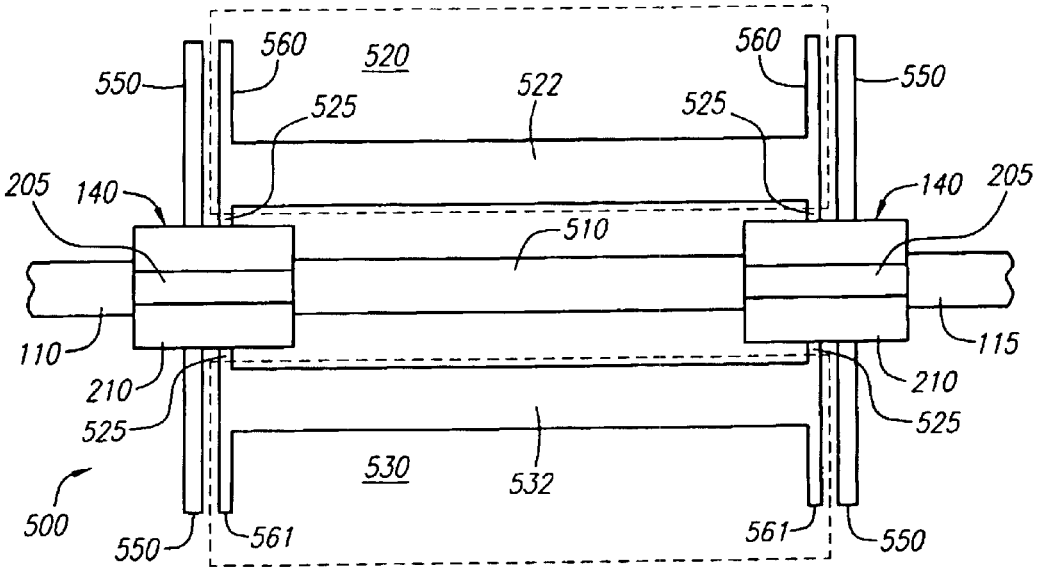
FIG. 5 is a top view of an alternative embodiment of a microstrip coupler according to the present invention.

FIG. 5 illustrates microstrip coupler 500 according to an alternative embodiment of the present invention. Microstrip coupler 500 includes discontinuities in through line, or microstrip conductor, 105. These gaps are spanned by controlled capacitance bridges 140.

Microstrip conductor 520 includes segment 522, which extends along a side of central portion 510 of microstrip conductor 105, allowing a portion of the signals transmitted through microstrip coupler 105 to be coupled into microstrip conductor 520. Similarly, microstrip conductor 530 includes segment 532, which extends along an opposing side of the central portion of microstrip conductor 510, allowing a portion of the signals transmitted through microstrip coupler 105 to be coupled into microstrip conductor 530. Segments 522 and 532 preferably have a length of $\lambda/4$, where $\lambda$ is the wavelength of a design frequency of operation of microstrip coupler 500.

Connecting microstrip traces 525 provide the function of jumpers or wire bridges between microstrip conductors 520 and 530. Conducting portions 205 of controlled capacitance bridges 140 connect central portion 510 of microstrip conductor 105 with input portion 110 and with output portion 115. The dielectrics 210 of controlled capacitance bridges 140 form capacitors between connecting microstrip traces 525, that pass under dielectrics 210 and conducting portions 205 of controlled capacitance bridges 140.

Additional capacitance is provided in pairs of trim traces by the interaction between segments 550 of microstrip conductor 105 and segments 560, 561 of microstrip conductors 520 and 530, respectively. In alternative embodiments of microstrip coupler 500, segments 550 have different lengths than those depicted. In further alternative embodiments of microstrip coupler 100, segments 550 are omitted.

Microstrip coupler 500 is preferably used for relatively lower-power applications as compared to microstrip coupler 100, because discontinuities between input portion 110 and output portion 115 may cause problems such as power dissipation. For example, when microstrip couplers with discontinuities are used in high-power applications, such dissipation can generate enough heat to damage components of the microstrip couplers.

While the best mode for practicing the invention has been described in detail, those of skill in the art will recognize that there are numerous alternative designs, embodiments, modifications and applied examples which are within the scope of the present invention. Accordingly, the scope of this invention is not limited to the previously described embodiments.

What is claimed is:

1. A microstrip coupler, comprising:

a first microstrip conductor configured to carry an input signal;

a second microstrip conductor disposed along a first side of the first microstrip conductor and configured to couple at least a portion of the input signal;

a third microstrip conductor disposed along a second side of the first microstrip conductor and configured to couple at least a portion of the input signal;

a first controlled capacitance bridge connecting the second microstrip conductor and the third microstrip conductor, the controlled capacitance bridge comprising:

a conducting layer; and a dielectric layer situated between the conducting layer and the first microstrip conductor.

2. The apparatus of claim 1, further comprising a second controlled capacitance bridge connecting the second microstrip conductor and the third micros trip conductor.

3. The apparatus of claim 1, wherein the input signal has even and odd modes and wherein the controlled capacitance bridge is configured to compensate for a difference in velocity between the even and odd modes.

4. The apparatus of claim 1, wherein the conducting layer comprises a metallized layer disposed along a first side of the dielectric layer, and wherein a capacitance is formed between the metallized layer and the first microstrip conductor.

5. The apparatus of claim 1, wherein the input signal has even and odd modes and wherein a width of a portion of the first microstrip conductor proximate the controlled capacitance bridge is configured to compensate for a difference in velocity between the even and odd modes.

6. A controlled capacitance bridge for connecting a first microstrip conductor and a second microstrip conductor of a microstrip coupler, wherein the first microstrip conductor is disposed along a first side of a third microstrip conductor configured to carry an input signal and the second microstrip conductor is disposed along a second side of the third microstrip conductor, the controlled capacitance bridge comprising:

a conducting layer; and a dielectric layer situated between the conducting layer and the third microstrip coupler.

7. The apparatus of claim 6, wherein the input signal has even and odd modes and wherein the controlled capacitance bridge is configured to compensate for a difference in velocity between the even and odd modes.

8. The apparatus of claim 6, wherein the conducting layer comprises a metallized layer disposed along a first side of the dielectric layer, and wherein a capacitance is formed between the metallized layer and the first microstrip conductor.

9. The apparatus of claim 7, wherein a width of the conducting layer is selected to compensate for the difference in velocity between the even and odd modes.

10. The apparatus of claim 7, wherein a thickness of the dielectric layer is selected to compensate for the difference in velocity between the even and odd modes.

11. A microstrip coupler, comprising: an input microstrip conductor configured to carry an input signal: a central microstrip conductor proximate the input microstrip conductor and seoarated from the input microstrip conductor by a first gap: an outout microstrip conductor proximate the central microstrip conductor and separated from the central microstrip, conductor by a second gap; a coupling microstrip conductor for coupling at least a portion of the input signal: wherein the coupling microstrip conductor comprises: a first coupled portion disposed along a first side of the central microstrip conductor; a second coupled portion disposed along a second side of the central microstrip conductor; a first connecting portion extending through the first gap and beneath the first controlled capacitance bridge for connecting a first end of the first coupled portion and a first end of the second coupled portion; and a second connecting portion extending through the second gap and beneath the second controlled capacitance bridge for connecting a second end of the first coupled portion and a second end of the second coupled portion.

12. A first controlled capacitance bridge for connecting the input microstrip conductor and the central microstrip conductor, the first controlled capacitance bridge comprising:

a first conducting layer; and a first dielectric situated between the first conducting layer and the first gap; and a second controlled capacitance bridge for connecting the central microstrip conductor and the output microstrip conductor, the second controlled capacitance bridge comprising:

a second conducting layer, and a second dielectric situated between the second conducting layer and the second gap.

* * * * *

UNITED STATES PATENT AND TRADEMARK OFFICE

CERTIFICATE OF CORRECTION

PATENT NO. : 6,794,954 B2 
DATED : September 21, 2004
INVENTOR(S) : Mark Gurvich, Alex Rabinovich and Jianqing He It is certified that error appears in the above-identified patent and that said Letters Patent is hereby corrected as shown below:

Title page,
Item [73], Assignee, "Power Wave Technologies, Inc." should be -- Powerwave Technologies, Inc. --
Item [75], Inventors, "Jianquing He" should be -- Jianqing He --
Item [57], ABSTRACT,
Line 1, "an" should be -- a --

Column 2,
Line 25, after "signal" insert -- . --
Line 37, after "is" insert -- a --

Column 8,
Line 58, "micros trip" should be -- microstrip --

Column 10,
Line 1, "seoarated" should be -- separated --
Line 2, "outout" should be -- output --

Signed and Sealed this

Fifth Day of April, 2005

JON W. DUDAS
*Director of the United States Patent and Trademark Office*